US008109222B2

(12) United States Patent
Fuhrmann

(10) Patent No.: US 8,109,222 B2
(45) Date of Patent: Feb. 7, 2012

(54) APPARATUS FOR FIXING FLOATING BODIES

(76) Inventor: Michael Fuhrmann, Munderfing (AT)

( * ) Notice: Subject to any disclaimer, the term of this patent is extended or adjusted under 35 U.S.C. 154(b) by 22 days.

(21) Appl. No.: 12/452,913

(22) PCT Filed: Jul. 30, 2008

(86) PCT No.: PCT/AT2008/000272

§ 371 (c)(1),
(2), (4) Date: Mar. 15, 2010

(87) PCT Pub. No.: WO2009/015403

PCT Pub. Date: Feb. 5, 2009

(65) Prior Publication Data

US 2010/0206210 A1 Aug. 19, 2010

(30) Foreign Application Priority Data

Aug. 1, 2007 (AT) ..... A 1207/2007

(51) Int. Cl.
*E02B 3/24* (2006.01)

(52) U.S. Cl. ..... 114/230.15; 114/230.18; 114/230.19

(58) Field of Classification Search ..... 114/230.15, 114/230.18, 230.19
See application file for complete search history.

(56) References Cited

U.S. PATENT DOCUMENTS

| | | | | |
|---|---|---|---|---|
| 2,965,064 | A * | 12/1960 | Wallace | 114/230.19 |
| 2,996,033 | A | 8/1961 | Yordi | |
| 3,064,615 | A | 11/1962 | Waltman | |
| 3,177,838 | A * | 4/1965 | Grimes | 114/230.18 |
| 4,144,831 | A | 3/1979 | Heydolph | |
| 4,206,717 | A * | 6/1980 | Okuda | 114/230.18 |
| 4,686,926 | A | 8/1987 | Vance | |
| 5,014,638 | A | 5/1991 | Ilves et al. | |
| 5,243,926 | A | 9/1993 | Wright et al. | |
| 2002/0104470 | A1 | 8/2002 | Leise | |

OTHER PUBLICATIONS

International Search Report.

* cited by examiner

*Primary Examiner* — Stephen Avila
(74) *Attorney, Agent, or Firm* — Collard & Roe, P.C.

(57) ABSTRACT

An apparatus is described for fixing floating bodies (1), in particular boats, to a landing body (2) with at least two holding booms (5) which are fixed to respective moorrings (4) by fittings (3) functioning as coupling elements, in each case at one end on the floating body (1) and at the other end on the landing body (2). In order to create advantageous conditions, it is proposed that at least one of the holding booms (5) be fixed, at least at one end, to the respective moorrings by the fitting (3) functioning as a coupling element so as to be rotationally fixed or rotationally resilient about an at least approximately vertical axis (7) with an adjustable and fixable angular offset (α).

14 Claims, 6 Drawing Sheets

APPARATUS FOR FIXING FLOATING BODIES

CROSS REFERENCE TO RELATED APPLICATIONS

This application is the National Stage of PCT/AT2008/000272 filed on Jul. 30, 2008, which claims priority under 35 U.S.C. §119 of Austrian Application No. A 1207/2007 filed on Aug. 1, 2007. The international application under PCT article 21(2) was not published in English.

1. Field of the Invention

The invention relates to an apparatus for fixing floating bodies, in particular boats, to a landing body with at least two holding booms which are fixed to respective mooring means by means of fittings functioning as coupling elements, in each case at one end on the floating body and at the other end on the landing body.

2. Description of the Prior Art

Floating bodies, in particular ships, boats or the like, are fixed in harbours or bays conventionally by mooring the floating body to the landing body, a floating body docking conventionally either longitudinally or transversely to the landing body. If the floating body docks longitudinally to the landing body, it is moored to the landing body at the bow and stern. If the floating body is positioned transversely to the landing body, it is moored to the landing body at the bow or stern and the end of the floating body that is remote from the landing body is fixed by means of an anchor or a mooring line in order to prevent undesirable drift of the ship. Securing to other ships or to the landing body is carried out in the conventional manner by means of fenders or the like.

Nevertheless, this prior art has the drawback that if the floating body at one end is fastened to the landing body using ropes and at the other end is held using an anchor, there is always the risk that the anchor will become detached and the floating body will drift off in an uncontrolled manner as a result. This risk exists in particular at choppy sea and has the consequence that other ships or the floating body itself or the landing body become damaged as a result of the prevailing wind and wave forces. If the fastening point remote from the landing body, the anchor or a mooring line become detached, danger is thus immediately at hand, as the floating body is fastened in a completely unsuitable manner to the landing body at the other end. This means that the ship must at all times be equipped with an anchor watch or the like in order to prevent the ship from potentially damaging itself or other boats. However, precisely when the floating body is momentarily not being used and thus also is not being watched, secure anchoring should also be ensured at all times.

It is therefore known to provide floating bodies which are fastened to a bank by means of holding booms. Floating bodies of this type, conventionally landing ships on rivers, to which other ships can be secured, are situated in the current and are fixed in relation to the bank by means of at least two holding booms. Drift of this floating body is avoided by way of additional holding ropes or prevented by holding booms arranged in the form of a triangle of forces, wherein in particular two points of engagement of two holding booms on the bank converge to a common holding point on the landing body or vice versa. Fittings functioning as coupling elements are in this case provided in the form of holding rings which are formed integrally with the holding boom and placed via appropriate bitts on the floating body or on the bank and secured thereto. Nevertheless, known holding booms of this type are not suitable for floating bodies which have to dock and cast off and change their berth relatively often, such as sailing boats, motor boats or the like, as the detaching or docking is associated with considerable effort and, in addition to the booms, a mooring of the floating body must necessarily be provided.

It is therefore known (U.S. Pat. No. 5,014,638) for fixing floating bodies, in particular for fixing ships to a landing stage, to provide holding booms which are made up of spring-mounted telescopic rods and are mounted on the land side so as to be able to rotate freely about a vertical axis and in addition so as to slide up and down along this axis. A connection by means of a ball-and-socket joint, which connection is freely movable in broad regions, is provided on the ship side. This apparatus has the drawback that fixing a ship requires the provision of at least three holding booms, at least two of which are to be arranged in the form of a triangle of forces in order to ensure secure anchoring of the ship. In addition, it is not possible to simply and rapidly adapt this system for use on different sizes and types of ship. A similar problem occurs in an apparatus which is known from U.S. Pat. No. 5,243,926 and in which the described holding boom is anchored to the floating body and to the landing stage so as to be rotationally fixed in its respectively associated fittings. A vertical movement of the holding booms about horizontal axes is provided to compensate for wave movements and rises of tide. This holding boom is embodied telescopically and contains springs for absorbing the tensile and compressive forces. U.S. Pat. No. 4,686,926 discloses a similar system without a telescopic guide. An absolutely unstable holding system, such as may be used at most for short-term anchoring, is disclosed by US 2002/0104470 A1 according to which holding booms are provided that are fastened, both on the ship and on the land side, to cables acting on fittings; however, this results in unreliable securing of the boat.

SUMMARY OF THE INVENTION

Starting from a prior art of the above-described type, the invention is based on the object of providing an apparatus for fixing floating bodies that allows, using simple means, secure fastening of the floating body to a landing body and thereby as far as possible avoids or prevents drifting and uncontrolled movements of the floating body, in particular at high wave strengths and wind strengths.

The invention achieves this object in that at least one of the holding booms is fixed, at least at one end, to the respective mooring means by the fitting functioning as a coupling element so as to be rotationally fixed or rotationally resilient about an at least approximately vertical axis with an adjustable and fixable angular offset.

For the simplest case, it is sufficient if the floating body is fastened to the landing body by means of the two holding booms. The distance from the landing body is fixed using the two holding booms, drift of the floating body to the side and obliquely to the rear in the direction of the landing body being prevented by the rotationally fixed or rotationally resilient fixing of at least one of the fittings to one end of the holding booms. The apparatus according to the invention introduces wave and wind forces acting on the floating body into the landing body directly via the holding booms. Whether the holding booms are in this case fastened to the floating body or landing body in a rotationally fixed or rotationally resilient manner depends in particular on respective conditions on site. Often, the rotationally fixed or rotationally resilient bearings will be provided on the floating body, in particular on bitts, winches or the like, as the rotationally fixed fixing of the booms to any desired landing bodies which are not prepared for an apparatus according to the invention will often be possible only with difficulty. As a result of the connection by means of holding booms between the floating body and landing body, forces acting on the floating body are absorbed right from the outset and introduced into the landing body. The invention thus avoids and suppresses from the outset impacts on the floating and landing bodies and thus introductions of excessive force. This type of fastening to the landing body reduces to a minimum the tendency of the floating body to drift and thus greatly reduces the risk of damage caused by collisions with other ships or with the landing body. It goes without saying that it is advisable to additionally secure the floating body, in particular at rough sea or in strong wind, in a known manner, such as for example using ropes, using an anchor or using a mooring. If the anchor and mooring lose their hold, the "rigid" fastening using the holding booms nevertheless holds the floating body securely in position. The fittings functioning as coupling elements can be shaped in any desired manner in order to be able to be advantageously fastened to corresponding mating pieces, the mooring means, such as in particular bitts, holding rings, cleats, winches or the like.

If the fitting has a receptacle engaging in a form-fitting manner into a corresponding mating piece provided on the mooring means, then the holding boom is rotationally secured to the mooring point in a simple manner. If the receptacle and mating piece are in this case embodied in the manner of a wedge spline or the like, then the angle of rotation of the holding booms in relation to the ship and landing bodies can additionally be set in a simple manner, for which purpose the receptacle would merely have to be attached to the corresponding mating piece with an appropriate angular offset.

In order for the floating body to be able to reliably compensate for even relatively high wave movements or in order for it to be able to follow a rise of tide accordingly, it is advisable if the fittings act on the booms so as to be adjustable so as to pivot freely about at least approximately horizontal and mutually parallel axes. Furthermore, it is advisable if the holding booms are embodied telescopically and have in the direction of displacement springs absorbing tensile or compressive forces. This allows forces acting on the floating body and energies to be absorbed and accommodated, in particular at relatively high wind strengths, so that the floating body and landing body are subjected to much lower loads. If, in this case, a displacement damper pertains to the holding booms, a build-up of wave movements is in addition prevented from the outset. The spring elements used are preferably, in addition to conventional steel springs or the like, plastics material springs. In order to be able to adapt the apparatus according to the invention to a broad range of conditions, in particular to fix it to various landing bodies or the like, it is advisable if the holding booms are embodied so as to be longitudinally adjustable. The longitudinal adjustment can in this case be carried out via the telescopic displacement means or else the holding booms are embodied in the longitudinal direction so as to be able to be assembled from a plurality of parts, in particular so as to be able to be screwed to one another or the like.

In order not only to be able to accommodate tensile and compressive forces in a damped or absorbed manner, but also to be able to advantageously dissipate forces acting laterally on the ship, it is advisable if the receptacle is mounted in the fitting or the mating piece is mounted in relation to the associated mooring means so as to be rotationally resilient about the at least approximately vertical axis and a torsional vibration damper pertains to the torsion spring if appropriate. In the simplest case, the torsional resilience is absorbed by an elastomer or the like which at the same time functions as a damper. If it should be possible to fasten the floating body to a broad range of landing bodies in an equally optimum manner, the fittings functioning as coupling elements can be fixed to the respective mooring means via intermediate pieces acting, on the one hand, on the fittings and, on the other hand, on the mooring means. A broad range of intermediate pieces or universal intermediate pieces are preferably provided for various mooring means such as bitts, holding rings, cleats or the like.

For fixing the intermediate pieces to cleats, particularly simple conditions are obtained if the intermediate pieces are embodied in a crosswise manner. One leg of the cross is in this case mounted at one end, preferably in an articulated manner, to the holding boom and can be inserted by its other end into a central recess of the cleat. The other leg forms a lateral stop for the cleat, preferably has a length corresponding to the length of the cleat and can be fixed to the cleat using a rope wrapped in the conventional manner around the cleat. Nevertheless, it is also possible to provide on the land or floating body side a ball coupling comprising for example a coupling socket or ball, associated at one end with the holding boom, and, on the land or floating body side, the corresponding mating piece. In terms of its function, this ball coupling can be embodied like a motor vehicle trailer coupling.

In order to ensure that the holding boom, when it is momentarily not required, does not impede or endanger ships or to avoid damage during docking and casting-off, it is advisable if at least one fitting per holding boom is adjustable between a coupling position and a rest position so as to be able to pivot about the at least approximately horizontal axis counter to the force of a spring, for which purpose a rope is provided that functions as a cord and acts at one end on the fitting and at the other end in the holding boom. Particularly simple construction conditions having low susceptibility to wear are in this case obtained if the holding boom is adjustable so as to be able to pivot between the coupling position and the rest position by way of the rope while prestressing a spring provided in the holding boom, preferably a rubbery-elastic plastics material block. If, for example, the land-side fitting has this means for lifting the holding boom, then said holding boom can, once detached from the floating body and with the spring designed appropriately, pivot upward from the fastening position into its rest position about the at least approximately horizontal axis.

In the case of relatively rough sea or strong wind, the holding booms can additionally be stayed using ropes arranged in the manner of a latticework, for which purpose it is advisable to provide corresponding eyes on the holding booms. Spring lines arranged next to the holding means could optionally be appropriately prestressed in order to support the holding booms, wherein the spring lines should display a working extension of <1%.

BRIEF DESCRIPTION OF THE DRAWING

The invention is schematically illustrated based on an exemplary embodiment in the drawings, in which.

DESCRIPTION OF THE PREFERRED EMBODIMENT

Figure 1:
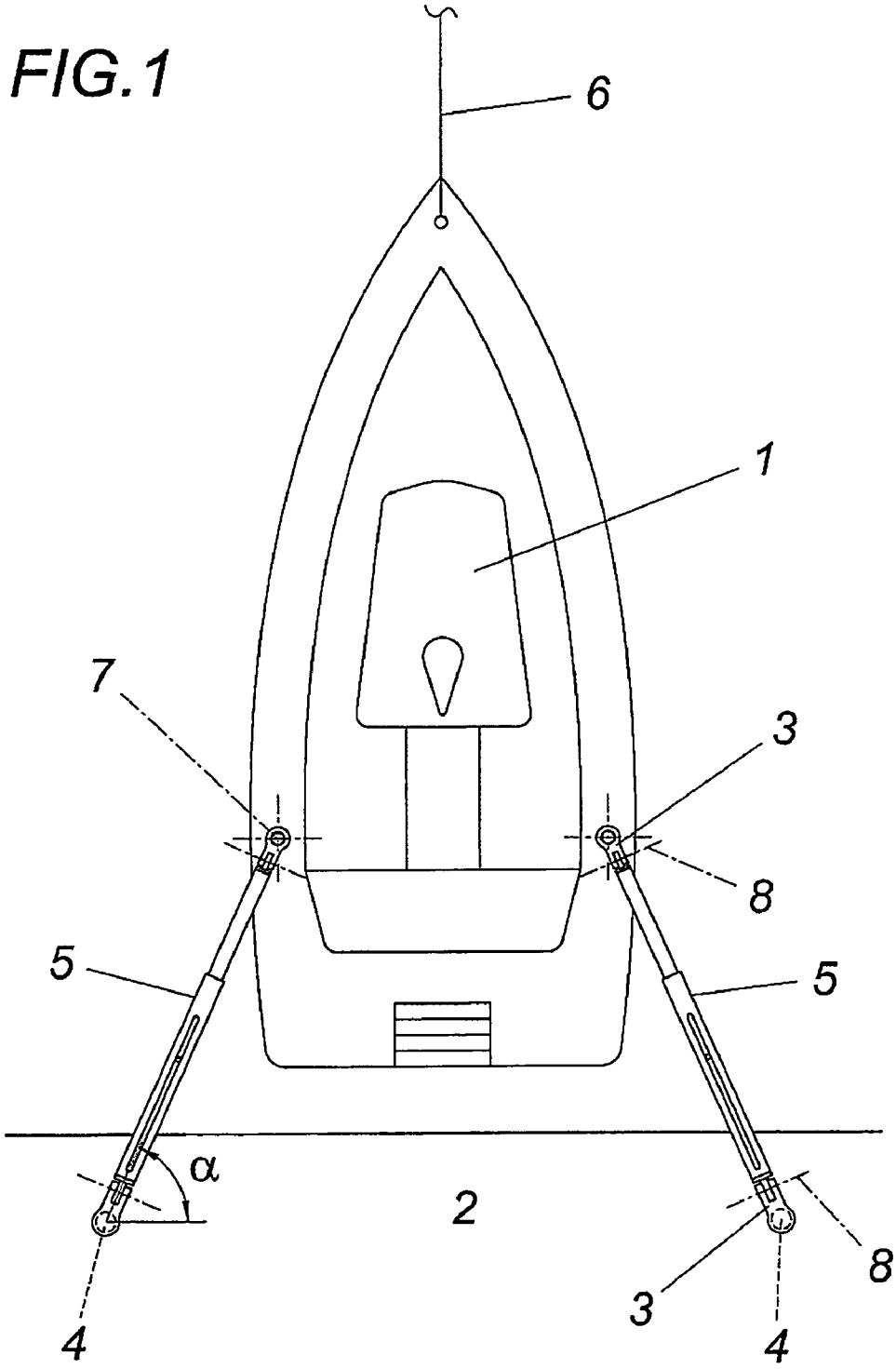
FIG. 1 is a plan view of a floating body fixed to a landing body using an apparatus according to the invention.

An apparatus for fixing floating bodies 1, in the illustrated exemplary embodiment a boat, to a landing body 2 comprises two holding booms 5 fixed to respective mooring means 4 by means of fittings 3 functioning as coupling elements, in each case at one end on the floating body 1 and at the other end on the landing body 2. The land-side mooring means 4 are in the illustrated exemplary embodiment in particular bills or the like sunk into the harbour mole. In addition, the floating body 1 is secured on the bow side using a bower anchor 6 or using a mooring or the like.

In order to be able to keep in a simple manner the floating body 1 at a constant distance from the landing body 2 and in this case to ensure secure fixing of the floating body 1 which is nevertheless securely fixed even if the anchor 6 should come loose, it is proposed in accordance with the invention that the holding booms 5 be fixed, at least at one end, namely on the floating body 1, to the associated mooring means 4 by the fitting 3 so as to be rotationally fixed or rotationally resilient about an at least approximately vertical axis 7. Bitts or winches or the like present on the floating body 1 are, again, provided as mooring means on the floating body 1. If the winches are lockable with respect to their rotary position or equipped with brakes, rotationally fixed or rotationally resilient supporting of the holding booms on the mooring means is ensured in a particularly simple manner. For docking, it may be advantageous if just one of the two holding booms 5 is rotationally fixed, while the other is embodied so as to be able to rotate freely. This allows the spacing of the holding boom to be adapted to various boat widths. Once the boat has been fixed, this freely rotatable holding boom 5 can then also be positioned in a rotationally fixed manner, for example by clamping, using a face spline or the like.

In order to be able to advantageously compensate for corresponding wave movements or a rise of tide, the fittings 3 act on the holding booms 5 so as to be able to pivot freely about at least approximately horizontal and mutually parallel axes 8. In addition, the holding booms 5 are embodied telescopically and springs 9 accommodating tensile and compressive forces in the direction of displacement pertain thereto.

In the illustrated exemplary embodiment, the fitting 3 for supporting the holding boom 5 in a rotationally fixed manner on the floating body 1 engages with a receptacle 10 having a wedge spline-like inner profile into a corresponding mating piece, a bitt having a wedge spline-like outer profile. In order to ensure that the receptacle 10 is mounted in the fitting 3 in relation to the associated mooring means 4 so as to be rotationally resilient about the at least approximately vertical axis 7, a plastics material spring 11 made of rubber or the like is provided between the fitting 3 and receptacle 10. The angle $\alpha$ of the holding booms 5 with respect to the floating body 1 and landing body 2 can be set in a simple manner by way of different attaching of the receptacles 10 to the wedge spline. It goes without saying that the receptacle must be secured in the respective position. Likewise, the receptacle could ensure rotationally fixed supporting of the holding boom in relation to the ship by means of a suitable brake, clamp or the like.

Figure 4:
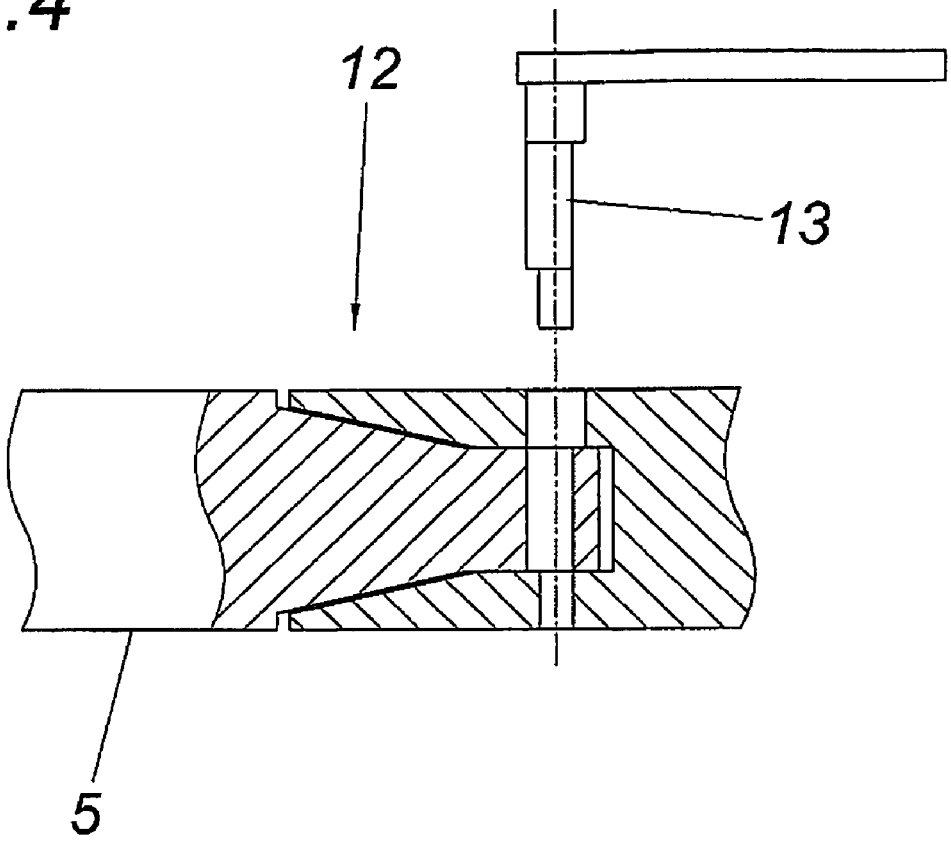
FIGS. 4 and 5 are partly cut-away side views of a holding boom according to the invention.
Figure 5:
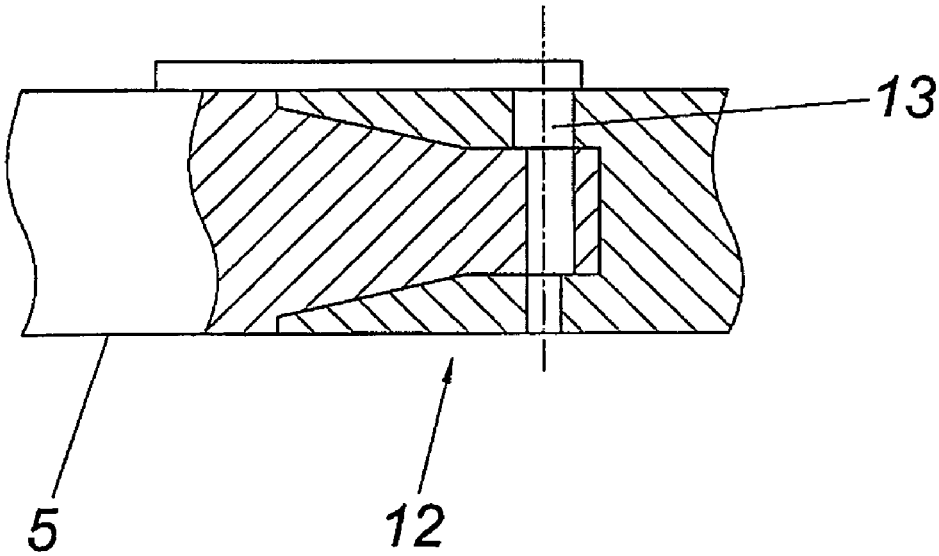

In order to be easier to handle, the holding booms 5 can be embodied in a plurality of parts in their longitudinal direction (FIGS. 4 and 5). A suitable coupling 12 is, on account of its stability, particularly advantageously a cone connection which ensures by means of an eccentric bolt 13 mutual securing of the two parts of the holding boom relative to each other. For securing and releasing the connection, the eccentric bolt 13, which is inserted into its receptacle, is in each case rotated through 180° about its bolt longitudinal axis and if appropriate secured in its rotary position.

Figure 3:
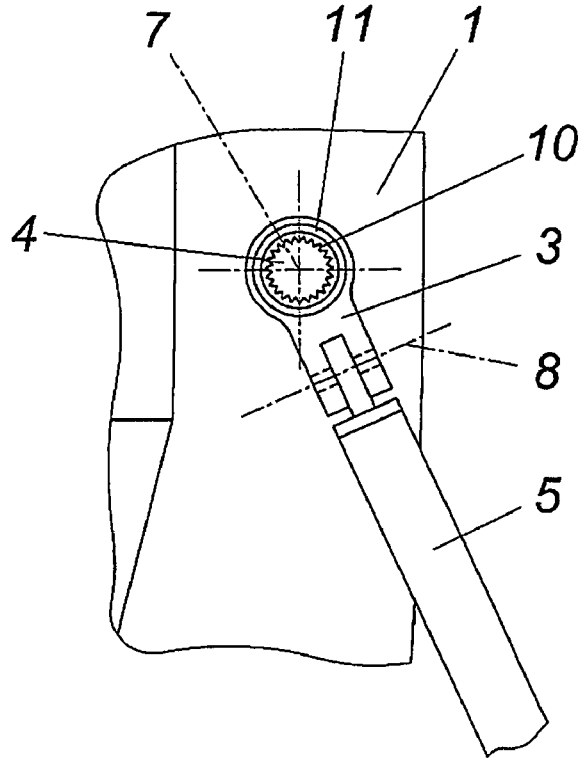
FIG. 3 is a further enlarged view of the holding boom from FIG. 2 fastened to the floating body.
Figure 2:
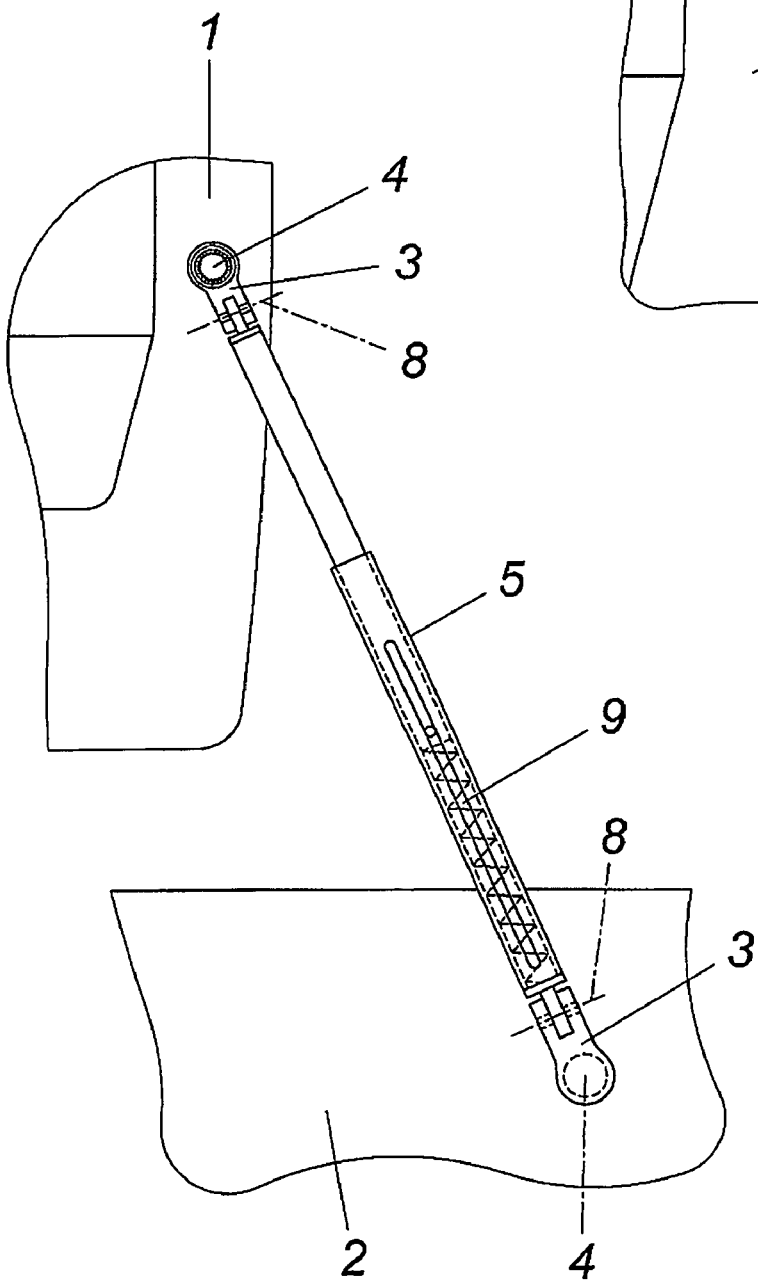
FIG. 2 is an enlarged plan view of the holding boom from FIG. 1.
Figure 6:
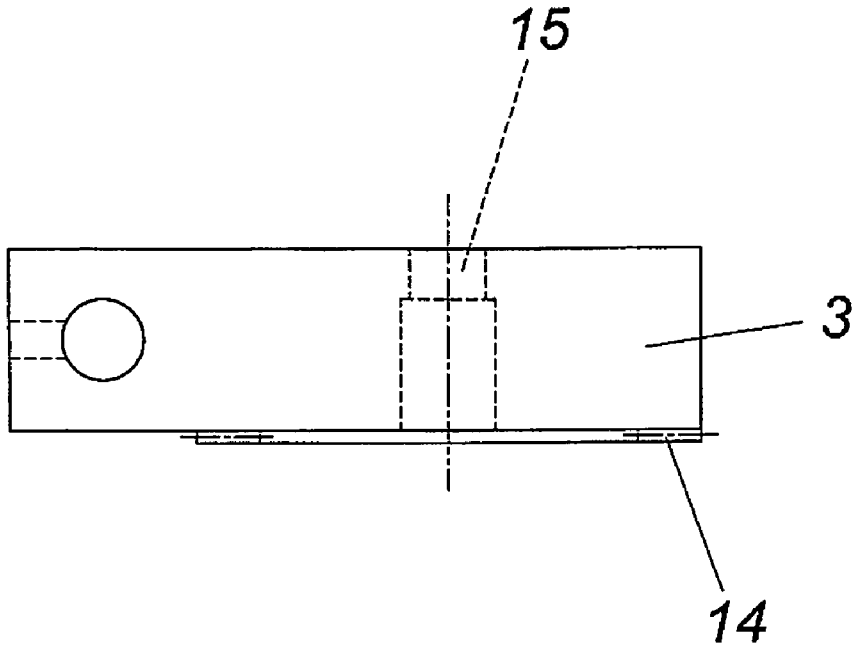
FIGS. 6 and 7 are a side view and a plan view of a constructional variant of a fastening fitting.
Figure 7:
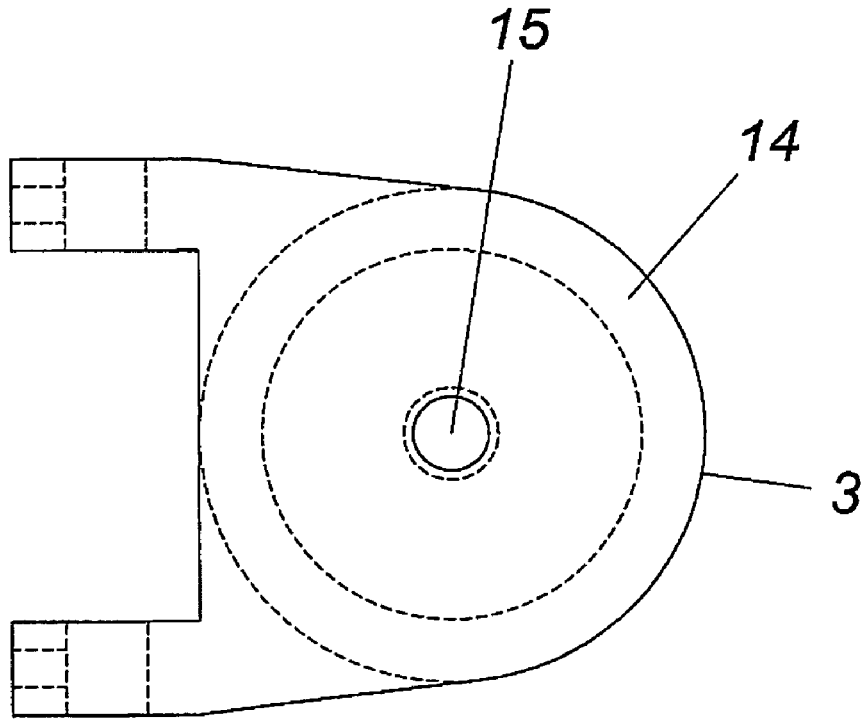

For rotationally securing the fitting 3 to a mooring means 5, it is not compulsory to provide a "radial" spline (FIG. 1 to 3); on the contrary, there is also the possibility of an "axial" spline 14, such as is illustrated in FIGS. 6 and 7. The fitting is in this case fixed with regard to its rotary position on the mooring means 5, for example by means of a clamping means penetrating the borehole 15, for example a screw. If it should be possible to fasten the fitting 3 to a broad range of mooring means 5, such as rings, bitts, cleats or the like in an equally optimum manner, the fittings 3 can be fixed to the respective mooring means 5 via intermediate pieces 16 acting, on the one hand, on the fittings 3 and, on the other hand, on the mooring means 5, for which purpose appropriate fastening options are to be provided on the fitting 3.

Figure 10:
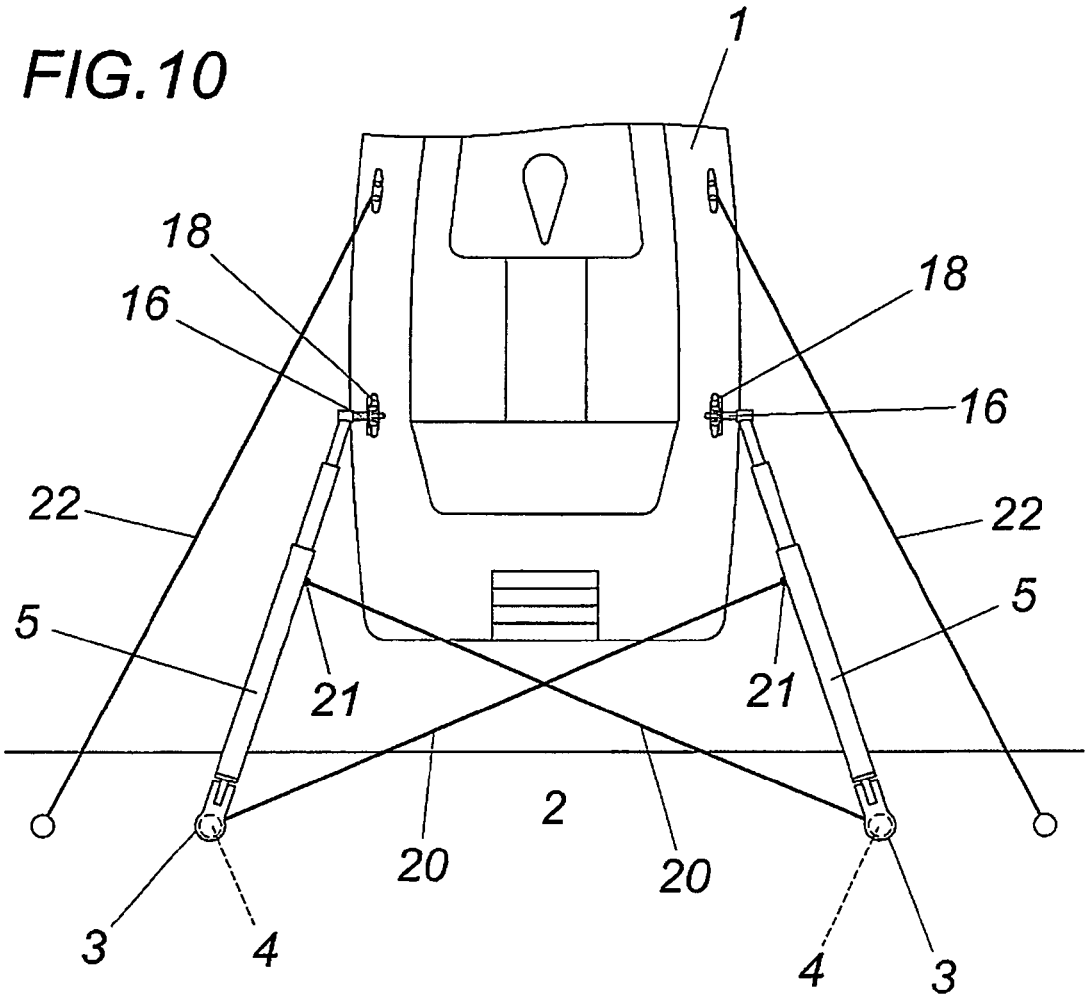
FIG. 10 is a plan view of the apparatus according to the invention with additional rope staying.
Figure 11:
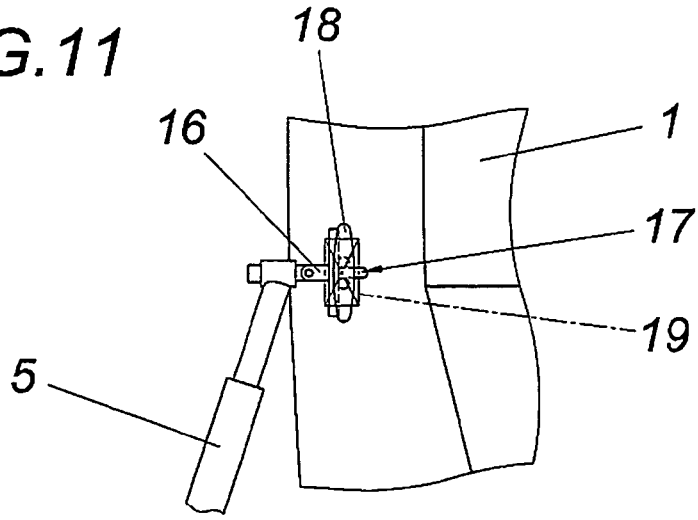
FIG. 11 shows an intermediate piece for fastening the holding boom to a cleat.

In FIGS. 10 and 11 crosswise intermediate pieces 16 are provided that act with a leg of the cross on the holding boom 5 and protrude through a central recess 17 of a cleat 18 and laterally rest against the cleat 18 with the other leg. This crosswise intermediate piece 16 is fixed to the cleat 18 using a rope 19 (merely indicated in the drawings) which is wrapped in the conventional manner both around the cleat 18 and around the leg resting thereagainst. In the case of relatively rough sea or strong wind, the holding booms 5 can additionally be stayed using ropes 20 arranged in the manner of a latticework, for which purpose corresponding eyes 21 are provided on the holding booms 5. A mooring which may if appropriate also have to be provided, spring lines 22, would have to be appropriately prestressed in order to support the holding booms 5. These spring lines 22 preferably display a working extension of <1%. However, this working extension can also be greater in the case of appropriate damper paths in the holding booms 5.

Figure 8:
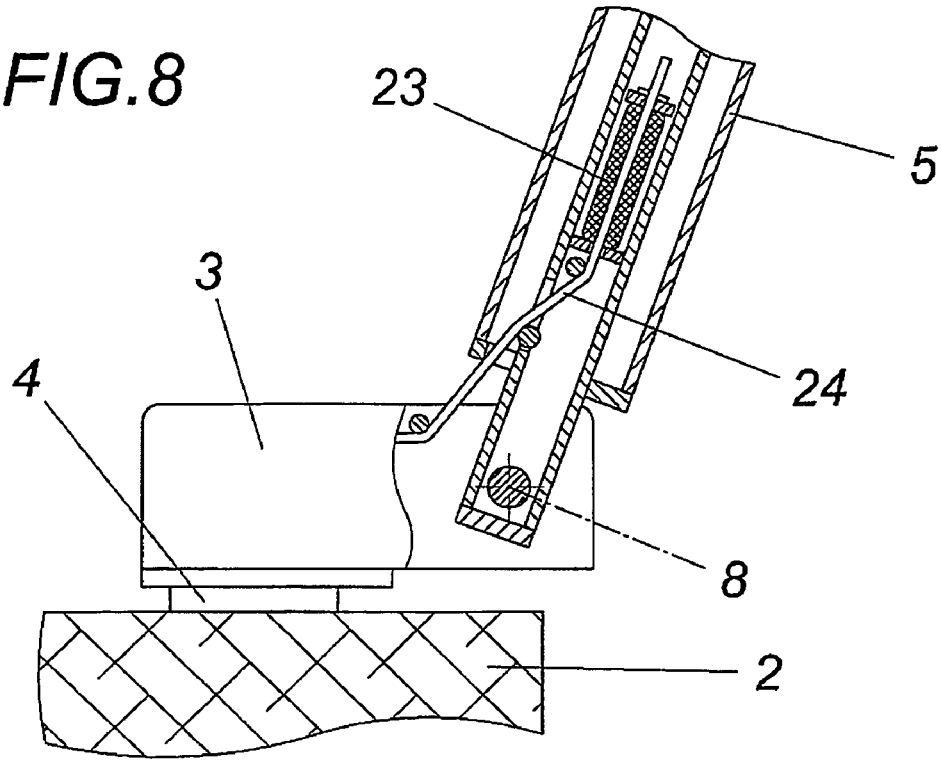
FIGS. 8 and 9 show a fastening fitting with a lifting means and with a holding boom located in the rest position or fastening position.
Figure 9:
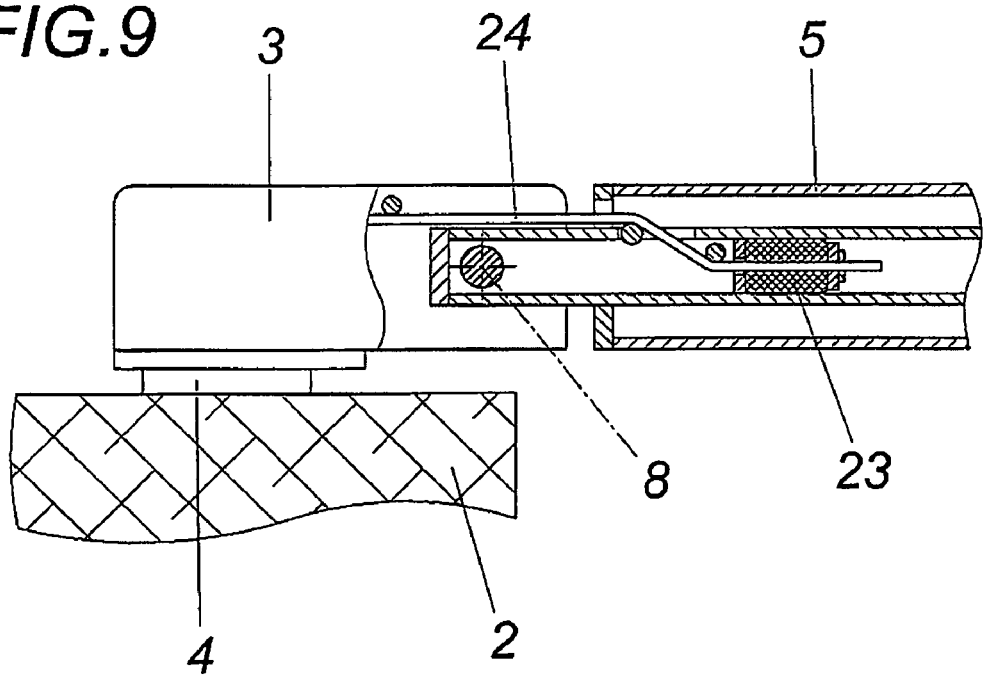

In order to ensure that that the holding boom 5, when it is momentarily not required, does not impede or endanger ships order to avoid damage during docking and casting-off, it is advisable if at least one fitting 3 per holding boom 5 is adjustable between a coupling position (FIG. 9) and a rest position (FIG. 8) so as to be able to pivot about the at least approximately horizontal axis 8 counter to the force of a spring 23, for which purpose a rope 24 is provided that functions as a cord and acts at one end on the fitting 3 and at the other end in the holding boom 5.

Particularly simple construction conditions having low susceptibility to wear are in this case obtained if the holding boom 5 is adjustable so as to be able to pivot between the coupling position (FIG. 9) and the rest position (FIG. 8) by way of the rope 24 while prestressing a spring 23 provided in the holding boom 5, preferably a rubbery-elastic plastics material block.

If, for example, the land-side fitting 3 has this means for lifting the holding boom 5, then said holding boom can, once detached from the floating body 1 and with the spring 23 designed appropriately, pivot upward from the fastening position into its rest position about the at least approximately horizontal axis 8.

The invention claimed is:

1. An apparatus for fixing a floating body to a landing body with at least two holding booms which are fixed to respective mooring means by means of fittings functioning as coupling elements, in each case at one end on the floating body and at the other end on the landing body, wherein at least one of the holding booms is fixed, at least at one end, to the respective mooring means by the fitting functioning as a coupling element so as to be rotationally fixed or rotationally resilient about an at least approximately vertical axis with an adjustable and fixable angular offset;

wherein the fittings functioning as coupling elements act on the holding booms so as to be adjustable so as to pivot freely about at least approximately horizontal and mutually parallel axes; and wherein at least one fitting per holding boom is adjustable between a coupling position and a rest position so as to be able to pivot about a respective one of the at least approximately horizontal and mutually parallel axes counter to a force of a spring.

2. The apparatus according to claim 1, wherein the holding booms are embodied telescopically and have in the direction of displacement springs absorbing tensile and compressive forces.

3. The apparatus according to claim 2, wherein a displacement damper pertains to the holding booms.

4. The apparatus according to claim 1, wherein the holding booms are embodied so as to be longitudinally adjustable.

5. The apparatus according to claim 1, wherein the fitting functioning as a coupling element has a receptacle engaging in a form-fitting manner into a corresponding mating piece.

6. The apparatus according to claim 5, wherein the receptacle is mounted in the fitting or the mating piece is mounted in relation to the associated mooring means so as to be rotationally resilient about the at least approximately vertical axis.

7. The apparatus according to claim 6, wherein a torsional vibration damper pertains to the torsion spring.

8. The apparatus according to claim 1, wherein the fittings are fixed to the respective mooring means via intermediate pieces acting, on the one hand, on the fittings and, on the other hand, on the mooring means.

9. The apparatus according to claim 8, wherein the intermediate piece is embodied in a crosswise manner.

10. The apparatus according to claim 8, wherein the intermediate piece provided on one side of the holding boom is a ball coupling.

11. The apparatus according to claim 1, wherein a rope is provided that functions as a cord and acts at one end on the fitting and at the other end in the holding boom.

12. The apparatus according to claim 11, wherein the spring is provided in the holding boom and the holding boom is adjustable so as to be able to pivot between the coupling position and the rest position by way of the rope while prestressing the spring.

13. The apparatus according to claim 1, wherein the holding booms are stayed in the manner of a latticework using ropes, for which purpose corresponding eyes are provided on the holding booms.

14. The apparatus according to claim 1, wherein spring lines are arranged next to the holding booms.

* * * * *